US006751934B2

(12) United States Patent
Focke et al.

(10) Patent No.: US 6,751,934 B2
(45) Date of Patent: Jun. 22, 2004

(54) PROCESS FOR PRODUCING CIGARETTE PACKS

(75) Inventors: Heinz Focke, Verden (DE); Kurt Meyer, Kirchlinteln-Neddenaver-bergen (DE); Martin Stiller, Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 10/046,199

(22) Filed: Jan. 16, 2002

(65) Prior Publication Data

US 2002/0095912 A1 Jul. 25, 2002

(30) Foreign Application Priority Data

Jan. 23, 2001 (DE) ..... 101 02 926

(51) Int. Cl.[7] ..... B65B 19/34
(52) U.S. Cl. ..... 53/444; 53/64
(58) Field of Search ..... 53/444, 461, 466, 53/389.3, 64

(56) References Cited

U.S. PATENT DOCUMENTS 4,030,511 A * 6/1977 Wahle ..... 131/280
4,599,699 A * 7/1986 Stewart-Cox et al. ..... 702/185
4,827,423 A * 5/1989 Beasley et al. ..... 700/96
4,962,840 A * 10/1990 Miura et al. ..... 198/347.1
5,243,408 A * 9/1993 Whitman, III ..... 356/430
5,385,622 A * 1/1995 Klingebiel ..... 156/157
5,521,498 A * 5/1996 Neri et al. ..... 324/229

FOREIGN PATENT DOCUMENTS

| | | | | |
|---|---|---|---|---|
| DE | 34 36 217 A1 | | 4/1986 | |
| DE | 36 39 972 A1 | | 5/1988 | |
| DE | 36 39 972 | * | 5/1988 | ..... B65H/7/00 |
| DE | 37 37 973 A1 | | 7/1988 | |
| DE | 39 07 615 A1 | | 9/1990 | |
| DE | 41 09 713 A1 | | 10/1991 | |
| DE | 41 10 342 A1 | | 10/1991 | |
| DE | 196 52 210 | * | 6/1998 | ..... B65B/57/00 |
| DE | 197 16 930 A1 | | 10/1998 | |
| DE | 199 14 297 A1 | | 10/2000 | |
| EP | 1 041 006 A2 | | 10/2000 | |

* cited by examiner

*Primary Examiner*—Rinaldi I. Rada
*Assistant Examiner*—Paul Durand
(74) *Attorney, Agent, or Firm*—Sughrue Mion, PLLC

(57) ABSTRACT

In the production and packaging of cigarettes, the procedure for carrying out a product changeover is such that the entire production and packaging installation is largely emptied. In the region of a film packer (16) and of a following multi-packer (17), subassemblies for producing web connections (splice) are controlled such that a last cigarette pack of the old configuration is assigned to a last cigarette multipack (24) and this is then separated out.

12 Claims, 6 Drawing Sheets

14
26
26
52
47
46
45
32
32
31
33
49
29
28
27
30
34
35

16
21
36
53
10
51
10
36
37

PROCESS FOR PRODUCING CIGARETTE PACKS

BACKGROUND OF THE INVENTION

The invention relates to a process for producing cigarette packs during a changeover of the pack contents and/or of the packaging material with the aid of at least one packaging machine—packer—to which cigarettes and packaging material are fed as a continuous material web and/or as blanks.

In the cigarette industry, there is an increasing need for carrying out, in a short period of time, a changeover of the pack contents, that is to say of the cigarettes and/or of the packaging material in the same production installation. This product or brand changeover may concern all the product features of the packs, that is to say the cigarettes as well as the packaging material in its entirety.

Up until now, the procedure has been such that, for a product changeover, the packaging machine or the entire production installation (line) is brought to a standstill following completion of the production of a certain brand. The material present in the installation, including the cigarettes which have been processed up to this point, is removed by hand and disposed of as waste. Thereafter, the new material is installed and the packaging machine or line is set in operation again with the new cigarettes and/or the new packaging material.

SUMMARY OF THE INVENTION

The object of the invention is to carry out the product or brand changeover during the production of cigarette packs such that the changeover only results in small production losses.

In order to achieve this object, the process according to the invention is characterized by the following features:

a) upon initiation of a "product changeover" operating phase, the (residual) quantity of previous cigarettes—old cigarettes—and/or previous packaging material—old material—which is still to be processed is determined, b) the feed of old cigarettes and/or old material to the packaging machine is limited to the (residual) quantity which is still to be processed, c) the new cigarettes that are to be packaged—new cigarettes—and/or the new packaging material which is to be processed—new material—are/is provided for feeding to the packaging machine following the old cigarettes and/or the old material, d) the last cigarette pack with the old cigarettes and/or the old material—old pack—and/or the first cigarette pack with the new cigarettes and/or the new material—new pack—are/is identified, e) the production of the new packs follows the production of the old packs without interruption.

A special feature of the invention is that, during a changeover, continuous material of the currently produced cigarette packs is connected by a so-called splice to the continuous material of the new pack which is to be produced. In the process according to the invention, the procedure is such that the material-web connection is assigned to a cigarette pack which can be identified and separated out, in particular to a multipack which can be separated out. This avoids the situation where the old material has to be removed from the movement paths and the new material has to be threaded in laboriously.

In order to realize the invention, the procedure is such that the packaging machine or the installation is emptied of the old packs to the extent where a residual quantity of cigarette packs which is necessary for processing purposes is left behind in individual subassemblies of the installation. The number of this residual stock of old packs is known. This makes it possible to determine the position of the web connection (splice) such that in particular the last old pack has the connecting location and that in particular the last multipack with the old packs contains all the web connections. This cigarette multipack is then separated out.

BRIEF DESCRIPTION OF THE DRAWINGS

Further (special) features of the invention are explained in more detail hereinbelow with reference to the drawings, in which.

EMBODIMENTS OF THE INVENTION

The drawings show an installation for producing cigarettes and cigarette packs 10 up until the point at which they are introduced into (dispatch) cartons 11. The example specifically concerns cigarette packs 10 of the hinge-lid-box type.

Figure 1:
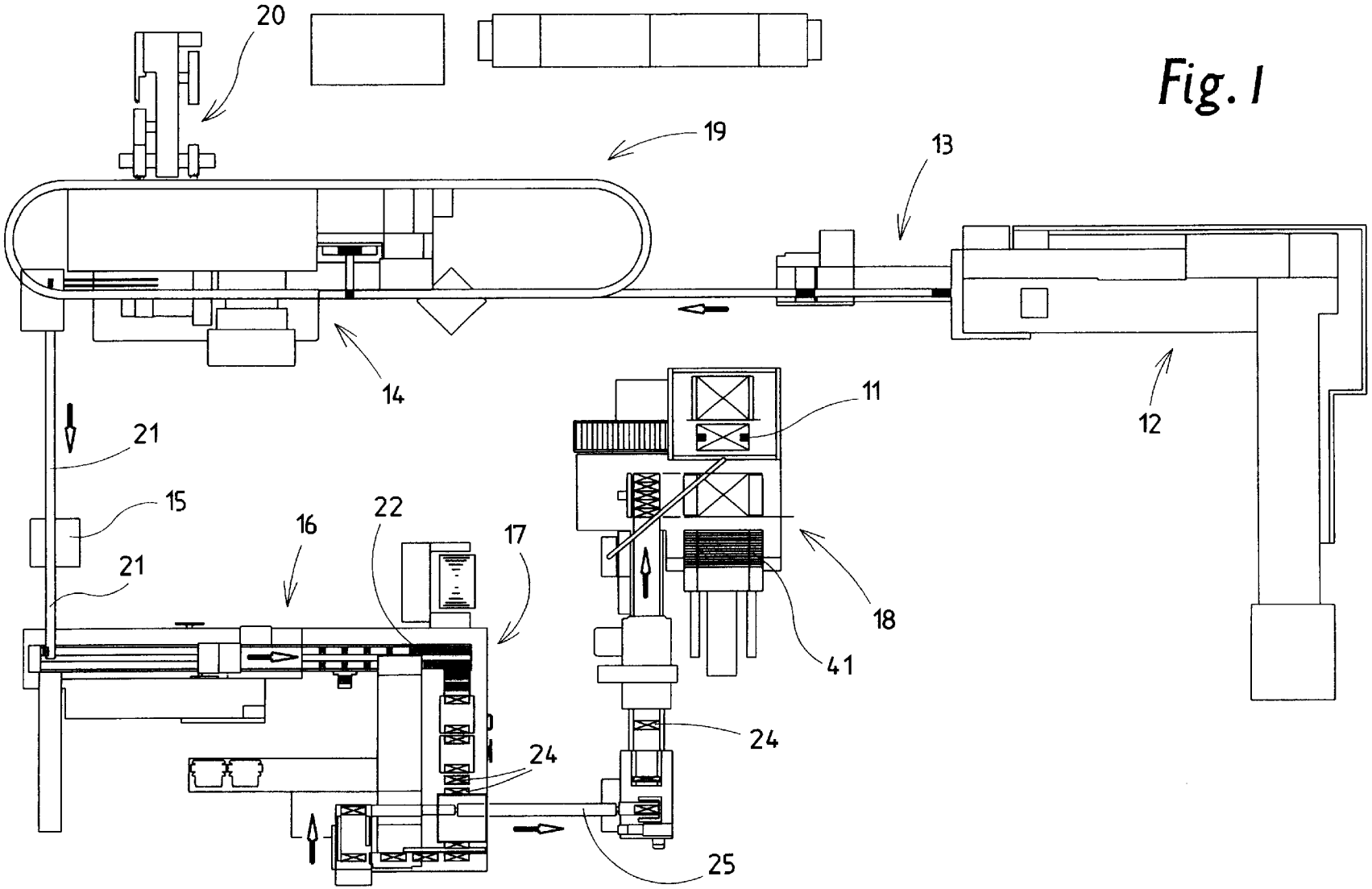
FIG. 1 shows a schematic plan view of an installation or production line for producing cigarette packs.
Figure 2:
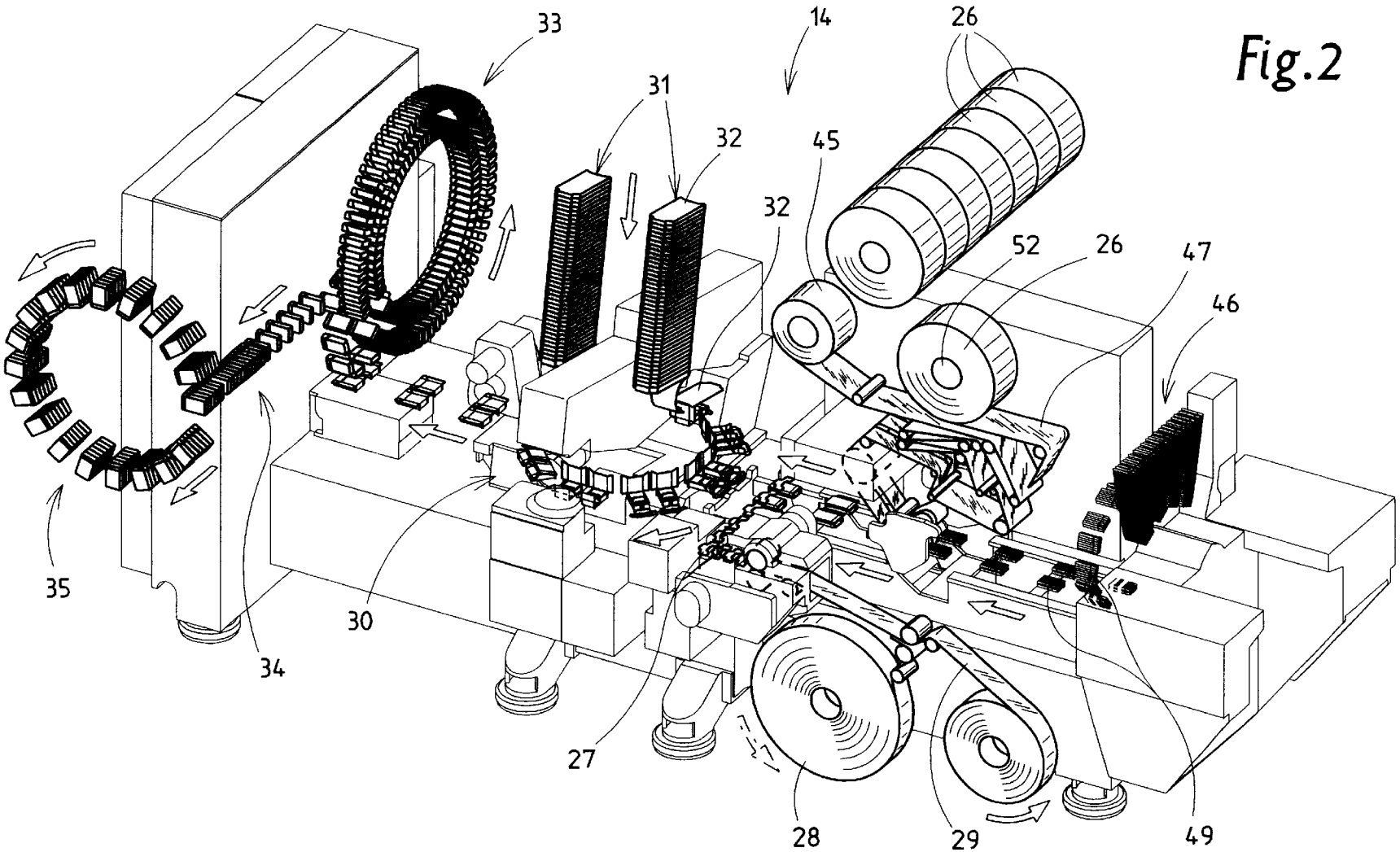
FIG. 2 shows a detail of the arrangement according to FIG. 1, namely a packaging machine—packer—in a perspective illustration.
Figure 3:
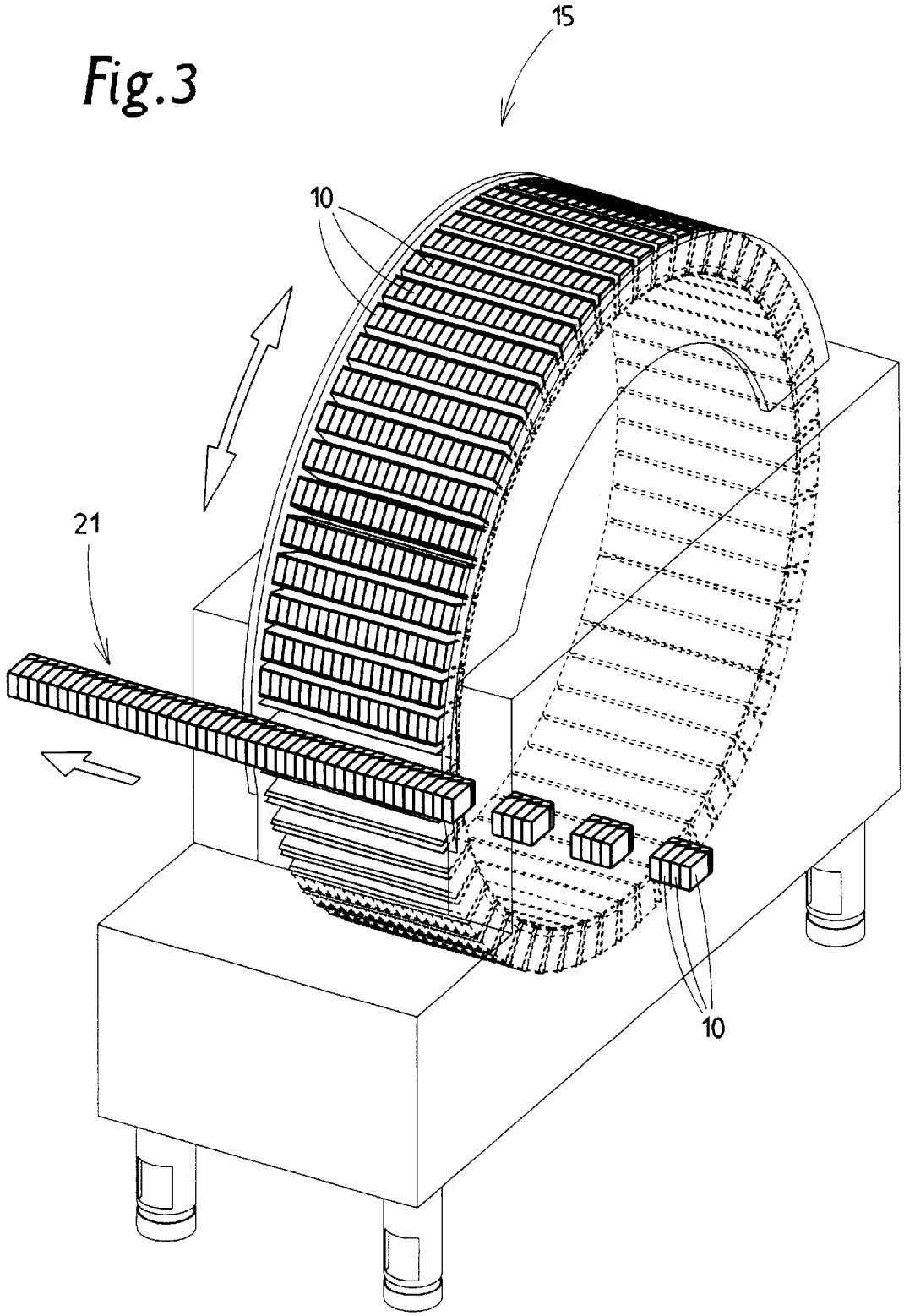
FIG. 3 shows a pack store, likewise in a schematic illustration.
Figure 4:
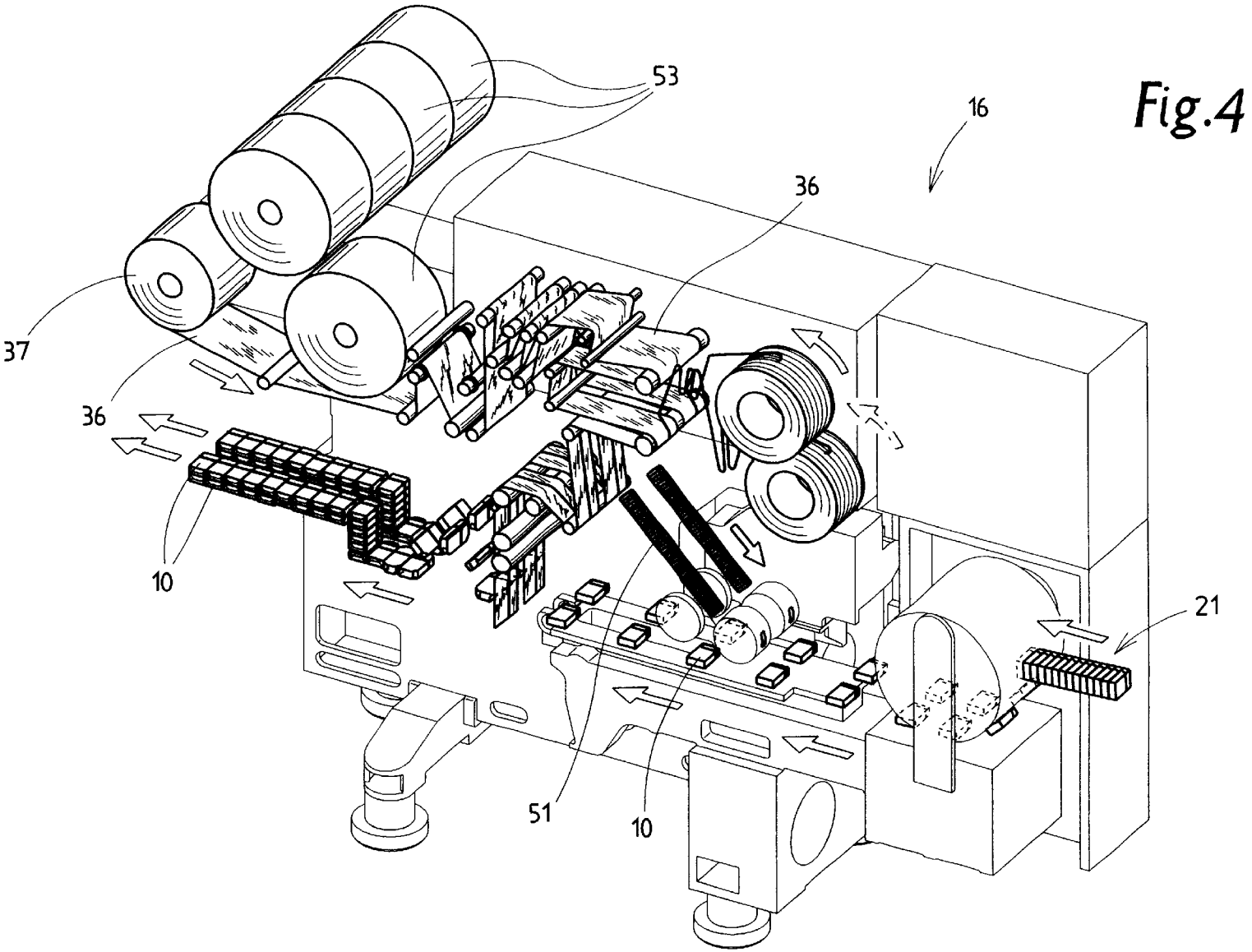
FIG. 4 shows a further packaging machine, namely a film packer, in a perspective illustration.
Figure 5:
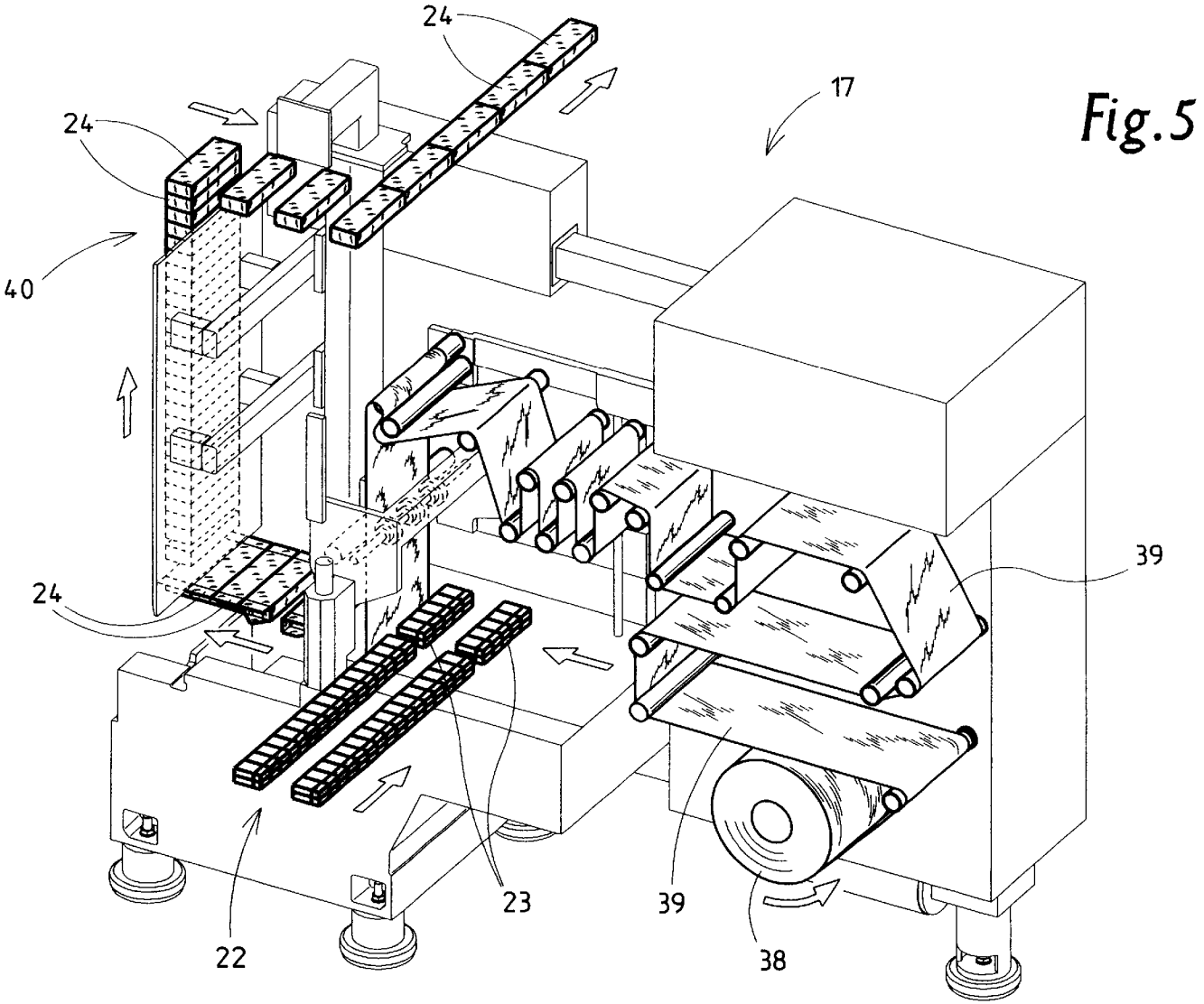
FIG. 5 shows a multipacker in a perspective illustration.
Figure 6:
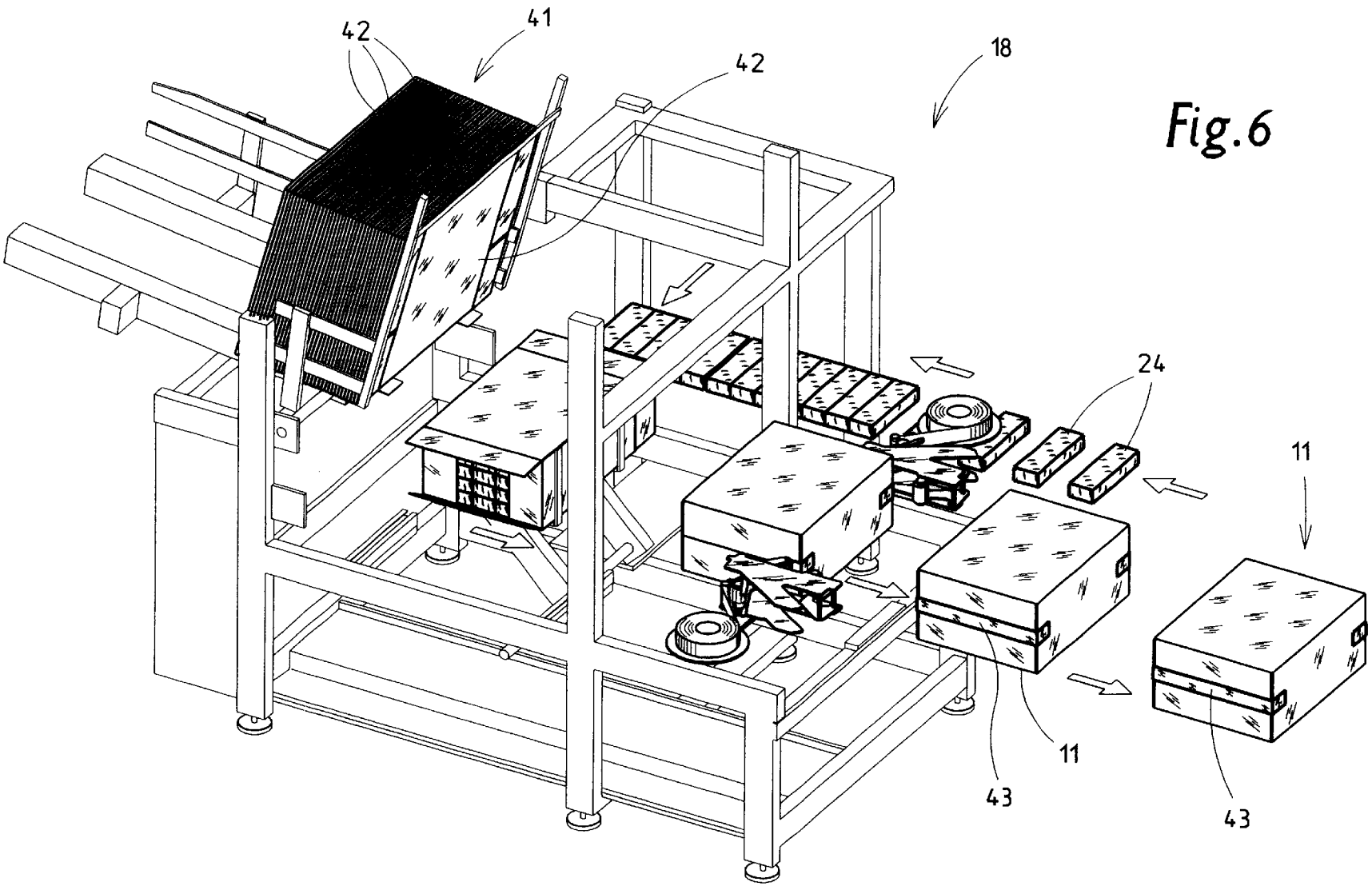
FIG. 6 shows a cartoner, likewise in a perspective illustration.

The (entire) installation or production line comprises, according to FIG. 1, a cigarette-production machine, that is to say a maker 12, a filter-attachment machine—tipper 13—connected thereto, a packaging machine for producing the cigarette packs 10, that is to say a packer 14, a pack store 15, a packaging machine for providing an outer wrapper on the cigarette packs 10 film packer 16—a multipacker 17 and a cartoner 18 for producing and filling the cartons 11. Other production-line arrangements are also of interest, namely a cigarette store 19 for accommodating a supply of cigarettes in the region of the packer 14. The packer 14, furthermore, is assigned a material unit 20. This stores packaging material and makes the material available to the packer 14.

The cigarette packs 10 produced by the packer 14 are transported to the film packer 16 via a relatively long pack conveyor 21. The pack store 15 for providing a supply of cigarette packs 10 is positioned in the region of said pack conveyor 21. Located between the film packer 16 and the multipacker 17 is a (double) conveying path 22 for two closely packs rows, located one above the other, of cigarette packs 10 for forming pack groups 23 for a multipack, namely a cigarette multipack 24, in each case. These, in turn, are fed to the cartoner 18 by a multipack conveyor 25.

The type of cigarette pack 10 selected here by way of example, namely a hinge-lid box, has a standard construction. A cigarette group is enclosed by an inner blank made of paper or tin foil. A collar, likewise consisting of thin cardboard, is fed to the cigarette block formed in this way. The unit comprising cigarette block and collar is enclosed by a blank which is produced, namely punched, elsewhere from (thin) cardboard. The blank usually has a (revenue stamp) strip fitted on it. The finished cigarette pack 10 is enclosed by an outer wrapper made of film.

The issue here then is a product or brand changeover, in which case it is assumed, by way of example, that it is not just the pack contents but also the packaging material in its entirety—old material—which has to be replaced by new material.

The special feature of the process is that the product or brand changeover takes place in a continuous manner, to be precise with the cooperation of the new packs and/or the new material. It is important for continuous material, that is to say webs of the packaging material, to be connected to one another, that is to say for new webs to be connected by a splice (web connection) to the respective old web. The formation and feeding of this web connection is controlled such that a certain, identifiable pack, in particular the last old pack, contains the web connections and the last-formed cigarette multipack 24 contains the pack with the connecting locations as well as the connecting location for the wrapper of the cigarette multipack 24. This cigarette multipack 24 is separated out.

Prior to the "brand changeover" operating state being initiated, the necessary information, in particular regarding type and extent of the changeover, is provided. The data can be communicated from a central computer to the individual installations or packaging machines and displayed on a monitor.

First of all, the new material is provided to the necessary extent in the individual machines and subassemblies. Web-like packaging material provided as reels is usually positioned on rotatable journals and, for processing, is drawn off the reels, which are driven in rotation. A material station usually has at least two journals, of which one serves for accommodating a replacement reel. For the material changeover, a reel of new material is positioned on the journal for the replacement reel, while the current (old) material continues to be drawn off from the reel on the active journal.

When the point in time for the changeover of the web-like material has been established—with reference to a certain, identifiable number of old packs—the web-connection operation is initiated in the conventional manner, that is to say the old web, which has been coming to an end, is connected by a splice to the new web drawn off from the new reel. The residual quantity of old material which is still being fed is calculated such that the last old pack or the last cigarette group with old cigarettes has the web connection.

The packaging or production installation is brought to a standstill when a known residual quantity comprising a defined number of (finished) cigarette packs is present in the installation. The operation of preparing the new material is carried out in the rest position. Thereafter, the installation is set in operation again with new cigarettes and new packaging material in the region of the packer 14, until the new packs follow the residual stock of old packs. Production is then continued. While the installation is at a standstill, a further feed of blanks by severing from material webs is brought about by the operation of a cutting subassembly for severing the blanks (knife block) being continued.

Accordingly, new reels 26 with tin foil or paper, to be precise a relatively large number of reels in a reel supply, are provided at the packer 14. A single new reel 26 is provided on a journal 52 for a replacement reel, for connection of a new web 47 to the old web coming to an end on the old reel 45.

Analogously, in the region of a collar subassembly, a new collar reel 28 is provided on a journal, for connection to the collar web 29 which is coming to an end.

Located in the region of a folding turret 30 are (two) blank magazines 31 with blanks 32 for the hinge-lid box. The cigarette packs 10 produced are fed into a first drying turret 33 and from the latter, via a transversely directed pack path 34, to a second drying turret 35.

The cigarette packs 10 passing out of the drying turret 35 are transported in a tightly packed row on the pack conveyor 21. At least some of the cigarette packs 10 pass into the pack store 15 and are transferred to the film packer 16, if required, on the continuing pack conveyor 21. The pack conveyor 21 comprises conveying belts without carry-along elements or other spacers, with the result that there is no determined relative position of the cigarette packs 10 on the pack conveyor 21.

Packaging material for the outer wrapper of the cigarette packs 10 has to be provided in the region of the film packer 16. This material is a film web 36, from which blanks for the outer wrapper are severed. The procedure here is as described above, that is to say by connection between the film web 36 drawn off from an old reel 37 (old web) and a new web, which comes from a new reel 53 positioned on a corresponding journal.

The finished cigarette packs 10, provided with an outer wrapper, pass to the multipacker 17 on a double conveying path 22, to be precise in a tightly packed row, in each case two cigarette packs 10 being located one above the other. By being pushed off transversely, it is thus possible for the pack groups 23, comprising a total of ten cigarette packs 10, to be formed as the contents of a cigarette multipack 24.

Material for wrapping the pack group 23 has to be provided in the region of the multipacker 17. In the example shown, a (paper) web—old web 39—is drawn off from a multipack reel—old reel 38—in order to produce blanks for the cigarette multipacks 24.

The cigarette multipacks 24 formed are conveyed into a pack tower 40 on the outlet side of the multipacker 17. The cigarette multipacks 24 are stacked one above the other in said pack tower. At the top end, the cigarette multipacks 24 are pushed off in the transverse direction and then transported in a single pack row on the multipack conveyor 25 to the cartoner 18.

The cartoner 18 is equipped with a carton magazine 41. Single, prepared carton blanks 42 are removed therefrom, erected and filled by virtue of the cigarette multipacks 24 being pushed in. A closure strip 43, namely an adhesive strip, is applied to the carton 11 in the region of base and end flaps.

When the production quantity of old packs which is to be produced has been more or less reached, first of all the maker 12 is run down and, finally, switched off. The conveying elements for transporting the cigarettes to the tipper 13 and the packer 14 are emptied, if appropriate completely emptied by hand. The new material is positioned in the individual subassemblies and machines for connection to the old web.

The packer 14 is usually provided with a cigarette magazine 46, from which cigarette groups 49 are conveyed away in order to be wrapped by the inner blank. When, in the region of this cigarette magazine 46, a certain minimum level of cigarettes has been reached, a signal is emitted (e.g. via a light barrier), and this effects the splice between the old web 39 and new web 47 of a new reel 48. A sufficient length of old web is then still present, with the result that the last cigarette group 49 is wrapped by a blank which has the connecting location between the old web 39 and new web 47. Once this last blank has been severed, the transportation of the material web, namely of the new web 47, is brought to a standstill, to be precise by virtue of a severing element (knife block) for producing the blanks being switched off. When the last cigarette group 49 has been pushed out of the cigarette magazine 46, the ejecting pushrods of the latter are brought to a standstill, to be precise preferably in accordance with U.S. Pat. No. 6,062,000.

For a changeover of the material for the production of the collar 27, a connection of the old collar web 29 to the new collar web is prepared and/or produced, to be precise such that the last cigarette group 49 with old cigarettes contains a collar of the previous material. Thereafter, either the drive for the collar web 29 is brought to a standstill or the splice for connecting the old web and the new web is not yet produced. In any case, no new collars are fed.

The blank magazines 31 with blanks 32 (old blanks) are likewise filled such that there is a sufficient number of blanks 32 present for the production of cigarette packs 10 (old packs).

The entire installation is continuously emptied. This applies to the drying turrets 33 and 35, the pack path 34, the pack conveyor 21 and the pack store 15.

The entire installation is emptied as far as the film packer 16, if appropriate with the aid of packs being removed manually. The film packer 16 is automatically switched off when, in the region of the pack conveyor 21 upstream of the film packer 16, just a residual stock (minimum filling level) of cigarette packs 10, for example ten cigarette packs, is present. The special feature is that, as the entire packaging installation is switched off, the stock of packs (old packs) which is still present in the installation is known. The production of the web connection in the region of the film packer 16 and in the region of the multipacker 17 is geared to this number of old packs, with the aim of the web connections which are still to be produced being assigned to a (last) cigarette multipack 24.

The splice or the web connection is applied in the region of the film packer 16 such that a sufficient number of blank lengths of the old material are still present up to the severing subassembly or knife block for the blanks. The splice is introduced when approximately 250 packs are still present upstream of the multipacker 17.

The last old packs and old multipacks are completed by resumption of the production of the (new) cigarettes and of the packaging of the same. The old material, if necessary, has been removed from the machines and subassemblies, in particular from the packer 14. New packs are then produced and fed to the film packer 16 by the pack conveyor 21. At the film packer, the new packs meet up with the residual stock of old packs, supplementing a continuous row of cigarette packs in the process. The film packer 16 is thus automatically set in operation again, as is the multipacker 17. Old packs and new packs thus run through the film packer 16 without interruption. This results in one of the cigarette multipacks 24 having old packs and new packs. Accordingly, this cigarette multipack 24 contains the cigarette pack 10 with the connecting locations of the inner wrapper (tin foil) and of the outer wrapper (film). Furthermore, this cigarette multipack 24 should also contain the web connection of the multipack wrapper.

This incorrect cigarette multipack 24 is separated out in the region of the pack tower 40. The procedure here is expediently such that the last cigarette pack 10 (old pack) is marked specifically, such that the marking can be detected electronically and a control signal can be derived therefrom. For example, this last cigarette pack 10 may have metallic contents (dummy contents). Furthermore, the last cigarette multipack 24, namely that having the splice, is clear to see, that is to say is provided with a visible marking, which facilitates the separating-out operation in the region of the pack tower 40.

A special feature is provided in the alternative method of conveying a number of pack groups corresponding to the contents of a cigarette multipack as an unwrapped pack group instead of providing them first with a multipack wrapper, in particular for conveying them into the pack tower 40. Here the non-wrapped pack groups can be easily identified and sorted out by the service personnel or by the appropriate monitoring devices. Expedient in this case is a total of four such non-wrapped cigarette multipacks, namely two multipacks each with old packs and two multipacks each with new packs.

The procedure here is such that the installation, at least the film packer 16 and multipacker 17, is stopped again. A number, for example five, cigarette multipacks 24 are removed from the pack tower 40, including the marked, presumably last old multipack. These cigarette multipacks 24 have to be opened and checked in their entirety. If the bottom of the cigarette multipacks 24 removed from the pack tower 40 has exclusively new packs or new material, the brand changeover has taken place correctly. The installation can then be set in operation again for the production exclusively of new packs.

The changeover of the material also covers blanks, in particular blanks 32 for hinge-lid boxes, but also (revenue stamp) strips 50 which are provided on the cigarette packs 10. The relevant blanks are located in a magazine, namely a blank magazine 31, on the one hand, and a (revenue stamp) strip magazine 51, on the other hand. For the material changeover, the old blanks are removed by hand and replaced by new blanks.

The abovedescribed brand changeover can also be carried out analogously for the production other types of (cigarette) packs. The control of the individual elements may be improved by the last cigarette pack 10 (old pack) being provided with a detectable sensor (instead of one or all of the cigarettes). As this sensor passes certain measuring positions, corresponding signals are emitted, in particular relating to the production of a web connection.

What is claimed is:

1. A process for producing cigarette packs during a product change over operating phase including a changeover of at least one of a pack contents and packaging material, with the aid of at least one packaging machine to which cigarettes and the packaging material are fed, said packaging material being fed as at least one of a continuous material web and blanks, said process comprising the steps of:

a) determining, upon initiation of said product changeover operating phase, a quantity, remaining to be processed of at least one of previous cigarettes and previous packaging material b) limiting the feed to the packaging machine, of at least one of said previous cigarettes and said previous packaging material, to the quantity remaining to be processed;

c) providing for feeding to the packaging machine at least one of new cigarettes, which are to be packaged, and new packaging material, which is to be processed following respectively at least one of the previous cigarettes and the previous packaging material; and identifying and separating out at least one of (1) the last cigarette pack with at least one of the previous cigarettes and the previous packaging material, and (2) the first cigarette pack with at least one of the new cigarettes and the new packaging material, and if said packaging material is the continuous material web, processing of the new packaging material following the processing of the previous packaging material without interruption, and connecting a start of a new web is connected to an end of an old web a web connection, at least one of the cigarette pack and a cigarette multipack having the web to form connection, with at least one web connection being identified and separated out.

2. The process according to claim 1, wherein both the cigarette pack and the cigarette multipack, having the web connection, are identified and separated out.

3. The process according to claim 1, further comprising the steps of:

if said packaging material consists of said blanks, then interrupting said feed of previous cigarettes and blanks to the packaging machine;

running the packaging machine until it is depleted of all but a remaining quantity of finished packs of the previous cigarettes;

keeping ready said remaining quantity of finished packs as an accumulated row of finished packs in a region of a pack conveyor (21) leading to a film packer (16) which applies an outer wrapper made of film to the cigarette packs;

then, switching off the packaging machine and removing any still remaining quantity of blanks for packs of the previous cigarettes, then restarting the packaging machine, and then feeding to the packaging machine at least one of new cigarettes to be packed and new blanks to be processed;

as soon as production of the new cigarettes has resumed, then conveying the new packs to a remaining quantity of packs of the previous cigarettes so that the new packs and the previous packs are fed together to the film packer (16);

forming, downstream of the film packer (16), groups of cigarette packs and feeding them to a multipacker (17) to produce cigarette multipacks (24) each comprising a group of the cigarette packs; and identifying and separating out a cigarette pack group consisting of both the previous cigarette packs and the new cigarettes.

4. The process according to claim 1, wherein the web connections of all the webs of the packaging material are assigned to at least one of the last cigarette pack and the last cigarette multipack, and, following completion, the latter is separated out.

5. The process according to claim 3, wherein a plurality of cigarette multipacks produced one after the other, including the cigarette multipack having the web connection of the packaging material of the cigarette multipack, are separated out and have their contents checked in order to establish the changeover between the previous cigarette packs and the new cigarette packs.

6. The process of claim 3, wherein the separating out of at least one of the cigarette pack and the cigarette multipack occurs in a region of an upright pack tower for cigarette multipacks.

7. The process of claim 3, wherein non-wrapped cigarette multipacks to be separated out comprise groups of cigarette packs kept ready and separated out.

8. Process for producing cigarette packs during a product changeover operating phase including a changeover of at least one of a pack contents and a packaging material, with an aid of at least one packaging machine to which cigarettes and packaging material are fed, said packaging material being fed as at least one of a continuous material web and blanks, said method comprising the steps of:

a) determining, upon initiation of said product changeover operating phase, the quantity, remains to be processed of at least one of previous cigarettes and previous packaging material;

b) limiting the feed to the packaging machine, of at least one of the previous cigarettes and the previous packaging material, to the quantity remaining to be processed;

c) providing, for feeding to the packaging machine, at least one of new cigarettes, which are to be packaged, and new packaging material, which is to be processed, following respectively at least one of the previous cigarettes and the previous packaging material;

d) assigning the web connections of all the webs of the packaging material to at least one of a last cigarette pack and a last cigarette multipack; and e) identifying and separating out at least one of (1) the last cigarette pack with at least one of the previous cigarettes and the previous packaging material, and (2) the first cigarette pack with at least one of the new cigarettes and the new packaging material.

9. The process according to claim 8, wherein the processing of the new packaging material follows the processing of the previous packaging material without interruption, and if said packaging material is the continuous material web, a start of a new web is connected to an end of an old web with the formation of a web connection, at least one of the cigarette pack and a cigarette multipack having the web connection, with at least one web connection being identified and separated out.

10. The process of claim 8, wherein the separating out of at least one of the cigarette pack and the cigarette multipack occurs in a region of an upright pack tower for cigarette multipacks.

11. The process of claim 8, wherein non-wrapped cigarette multipacks to be separated out comprise groups of cigarette packs kept ready and separated out.

12. The process according to claim 8, wherein a plurality of cigarette multipacks produced one after the other, including the cigarette multipack having the web connection of the packaging material of the cigarette multipack, are separated out and have their contents checked in order to establish the changeover between the previous cigarette packs and the new cigarette packs.

* * * * *